US006029377A

United States Patent [19]

Niikura et al.

[11] Patent Number: 6,029,377

[45] **Date of Patent: *Feb. 29, 2000**

[54] ATHLETIC SHOE

[75] Inventors: Takayuki Niikura; Tadatoshi Yamada, both of Saitama, Japan

[73] Assignee: Bridgestone Sports, Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/099,929

[22] Filed: Jun. 19, 1998

[30] Foreign Application Priority Data

Jun. 19, 1997 [JP] Japan ..... 9-162624
Nov. 11, 1997 [JP] Japan ..... 9-308709

[51] Int. Cl.[7] ..... A43C 15/00; A43B 23/28

[52] U.S. Cl. ..... 36/67 R; 36/59 R; 36/59 C

[58] Field of Search ..... 36/67 R, 67 A, 36/59 R, 59 C, 59 A, 61

[56] References Cited

U.S. PATENT DOCUMENTS

| | | | |
|---|---|---|---|
| 628,209 | 7/1899 | O'Sullivan | 36/59 R |
| 1,313,118 | 8/1919 | Santacroce | 36/59 C |
| 1,524,782 | 2/1925 | Clarke | 36/59 R |
| 1,559,450 | 10/1925 | Oakley | 36/59 C |
| 2,853,809 | 9/1958 | Bianchi | 36/59 C |
| 4,375,729 | 3/1983 | Buchanen, III | 36/59 R |
| 5,324,369 | 6/1994 | Yamada | 36/59 A |
| 5,761,832 | 6/1998 | George | 36/59 C |
| 5,768,802 | 6/1998 | Bramani | 36/59 C |

*Primary Examiner*—M. D. Patterson
*Attorney, Agent, or Firm*—Sughrue, Mion, Zinn, Macpeak & Seas, PLLC

[57] ABSTRACT

An athletic shoe has a sole composed of an inner layer and an outer layer that comes into contact with the ground surface. In the athletic shoe, a plurality of downward projecting projections are formed on the lower surface of the outer layer as parts of the outer layer, and a ring-shaped flange portion is formed as a part of the outer layer to surround the corresponding projection. The ring-shaped flange portion slants upward from its outer edge toward the inner edge. When a downward pressure greater than a predetermined value acts onto a portion where the projection and the corresponding flange portion are formed, the flange deforms in order to move the projection downward. In another athletic shoe, a plurality of projections is formed on the outer surface of a sole, and a depression is formed in the outer surface of the sole in the vicinity of each of the projections. The athletic shoe is excellent in terms of performance in gripping a soft ground surface such as a lawn surface and the easiness of walking on hard surfaces such as a paved path or a floor.

5 Claims, 8 Drawing Sheets

ATHLETIC SHOE

BACKGROUND OF THE INVENTION

1. Field of the Invention

The present invention relates to an athletic shoe (e.g., a golf shoe) having anti-slip projections on its sole.

2. Related Art

As anti-slip spikes provided on the soles of athletic shoes such as golf shoes, there have been employed metal studs used in so-called spike shoes and each having a metal pin of a conical shape or a truncated conical shape, rubber studs used in so-called spike-less shoes and having a cylindrical shape or a truncated conical shape, and soft spikes used in so-called soft spike shoes and having a mushroom-cap-shaped projection. The metal studs and the soft spikes are removably attached to the sole of each shoe by means of threads, whereas the rubber studs are formed integrally with the sole such that parts of the sole are projected to form the studs. Many spikes are provided on the sole mainly at the heel portion and tread portion (area between the arch portion and the toe portion) of the sole where the weight of a user acts during walking or playing.

Among the various types of athletic-shoe spikes, the metal pins of the metal studs are projections formed of a hard material. Therefore, golf shoes using metal studs provide excellent performance in gripping a lawn surface, and therefore are most suitable for playing and walking at each hole. However, walking on a hard surface such as a paved path or the floor of a clubhouse is not comfortable and easily causes fatigue due to pushing up by the studs. Further, the metal studs are likely to scrape grass of the green, resulting in roughed green.

Since rubber studs are sufficiently flexible, golf shoes using rubber studs, unlike the above-mentioned golf shoes using metal studs, do not have the drawback stemming from pushing up. However, the golf shoes using rubber studs have a drawback that they do not sufficiently provide the performance of gripping lawn surface during playing or walking at each hole.

Since the mushroom-shaped soft spikes do not have the drawbacks involved in the metal studs and the rubber studs, the mushroom-shaped soft spikes have recently attracted a great deal of attention. However, since the mushroom-shaped soft spikes have a cap portion that comes in contact with the ground surface through a large contact area, the mushroom-shaped soft spikes easily become loose, and may drop during play.

SUMMARY OF THE INVENTION

The present invention has been accomplished in view of the foregoing fact, and an object of the present invention is to provide an athletic shoe having anti-slip projections on its sole, which shoe is excellent in terms of performance in gripping a soft ground surface such as a lawn surface and the easiness of walking on hard surfaces such as a paved path or a floor.

In order to achieve the objects, according to a first aspect of the present invention, there is provided an athletic shoe which has a sole composed of an inner layer and an outer layer that comes into contact with the ground surface, wherein a plurality of downward projecting projections are formed on the lower surface of the outer layer as parts of the outer layer, and a ring-shaped flange portion is formed as a part of the outer layer to surround the corresponding projection, the ring-shaped flange portion slanting upward from its outer edge toward the inner edge, whereby when a downward pressure greater than a predetermined value acts onto a portion where the projection and the corresponding flange portion are formed, the flange deforms in order to move the projection downward.

According to a second aspect of the present invention, there is provided an athletic shoe in which a plurality of projections are formed on the outer surface of a sole, and a depression is formed in the outer surface of the sole in the vicinity of each of the projections. The "outer surface of the sole" denotes a sole surface where neither projections nor depressions are formed.

In the athletic shoe according to the first aspect of the invention, when a downward pressure greater than a predetermined value acts on the portion where the projection and the corresponding flange portion are formed, the flange portion, which slants upward from the outer edge toward the inner edge, deforms due to the pressure such that the flange portion becomes substantially flat or the flange portion slants downward from the outer edge toward the inner edge. As a result, the joint portion between the projection and the flange portion moves downward, so that the projection projects downward. Accordingly, when a large pressure acts on the portion of the sole where the projection and the corresponding flange portion are formed, while, for example, a player swings a club, the projection moves downward due to deformation of the flange portion, so that the projection length of the projection from the sole increases, resulting in an enhanced gripping performance against a soft ground surface such as a lawn surface. When the pressure that has deformed the flange portion is removed, the flange portion returns to its original state. Meanwhile, during walking, a relatively small pressure acts on the portion where the projection and the corresponding flange portion are formed, so that the flange portion hardly deforms, and therefore the projection does not move downward. Therefore, the projection length of the projection from the sole is minimized, so that comfortable feel can be obtained during walking on a hard surface such as a paved path or a floor.

In the athletic shoe according the second aspect of the present invention, a projection and a depression formed in the vicinity of the projection constitute anti-slip means. Therefore, when a downward pressure greater than a predetermined value acts on the portion where the projection and the depression are formed, while, for example, a player swings a club, the projection sticks into the ground surface, and part of the ground enters the depression, so that the projection and the depression cooperatively grip the ground surface over a wide area. Therefore, the shoe achieves effective performance in gripping a soft and slippery ground surface such as a lawn surface, so that slip-prevention effect is obtained effectively. Further, since the depression is provided in the vicinity of the projection, the height of the projection can be made less than that of conventional projections if desired. Especially, when metal studs are used, the height of the metal pins can be decreased by at least an amount corresponding to the depth of the depression. Accordingly, the length of the projection from the sole can be decreased, and therefore pushing up by the projection can be suppressed, so that comfortable feel can be obtained during walking on a hard surface such as a paved path or a floor.

DESCRIPTION OF THE INVENTION AND PREFERRED EMBODIMENTS

The first and second aspects of the present invention will be described in more detail.

First Aspect of the Invention

The sole used in the athletic shoe according to the first aspect of the present invention is composed of an inner layer and an outer layer that comes into contact with the ground surface. Examples of materials suitable for the inner layer include foamed elastic products such as foamed rubber and foamed plastic; rubber; and the like. More specifically, foamed EVA (ethylene vinylacetate), ordinary foamed rubber, foamed polyurethane, and the like are preferably used.

Pressure acting on the sole from above is transmitted to the flange portion of the outer layer via the inner layer. However, if the inner layer is excessively hard, the pressure is transmitted to the flange portion while being hardly absorbed by the inner layer, so that the flange portion deforms even which a small pressure acts on the sole. By contrast, if the inner layer is excessively soft, the pressure is transmitted to the flange portion while being mostly absorbed by the inner layer, so that the flange portion does not deform even when a large pressure acts on the sole. Therefore, the inner layer preferably has a proper flexibility, and more specifically, the material of the inner layer preferably has a hardness of 40–80°, more preferably, 50–70° (Asker hardness).

Examples of materials suitable for the outer layer include rubbers and rubber-like elastic materials. More specifically, ordinary solid rubber, thermoplastic urethane, Nylon, and the like are preferably used. The hardness of the outer layer must be such that when a downward pressure greater than a predetermined value acts on a portion where the projection and the corresponding flange portion are formed, the flange portion deforms in order to move the projection downward and such that when the pressure is removed, the flange portion returns to its original state. Therefore, the material of the outer layer preferably has a hardness of 50–90°, more preferably 60–80° (JIS-A hardness). Each of the inner and outer layers may have a single-layer structure of a single material, or a multi-layer structure composed of a plurality of layers formed of different materials.

Figure 1:
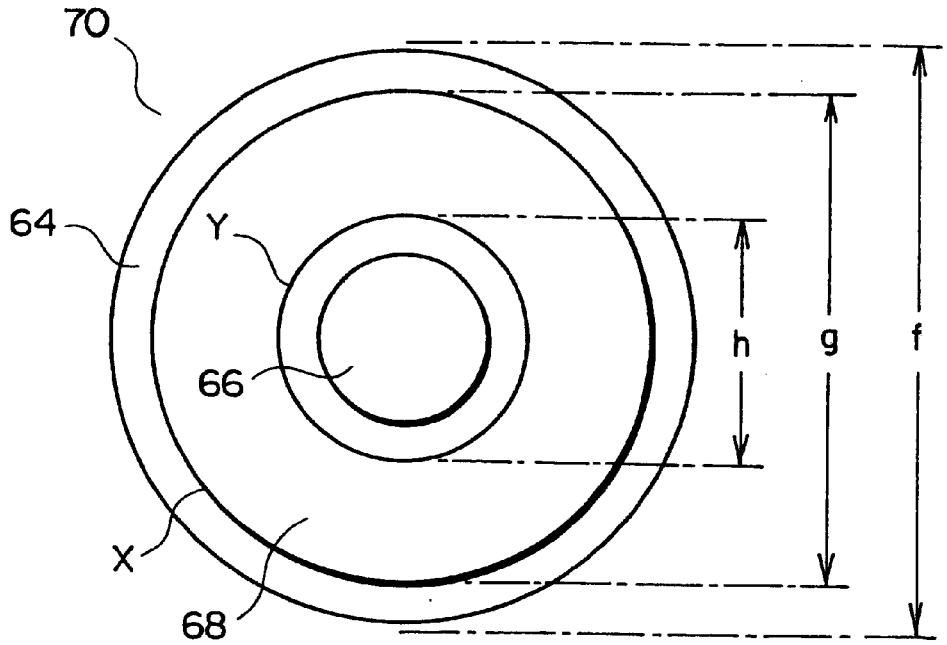
FIG. 1 is a plan view showing an example of a sole on which a projection and a flange portion are provided and which are used in an athletic shoe according to the first aspect of the present invention.
Figure 2:
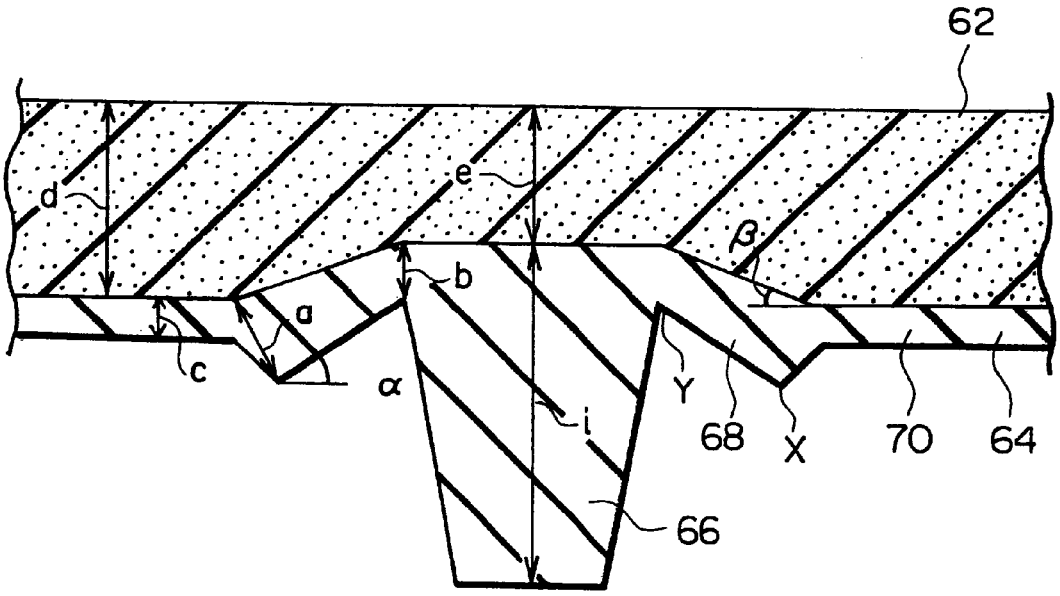
FIG. 2 is a vertical cross-sectional view of the projection and the flange portion shown in FIG. 1.

As shown in FIGS. 1 and 2, the sole used in the athletic shoe according to the first aspect of the present invention is composed of an inner layer 62 and an outer layer 64 that comes into contact with the ground surface. A plurality of downward projecting projections 66 are formed on the lower surface of the outer layer 64 as parts of the outer layer 64, and a ring-shaped flange portion 68 is formed as a part of the outer layer 64 to surround the projection 66. The ring-shaped flange portion 68 slants upward from its outer edge toward the inner edge. As a result, when the sole of the first aspect is in an ordinary state, the vertical position of the lower surface of the inner layer 62 is shaped at the portion where the flange 68 is formed such that the position is slanted upward from the outer edge to the inner edge of the flange portion 68, and becomes highest at the position where the projection 66 is formed.

No limitation is imposed on the shape of the projection. For example, the projection may be of a cylindrical-columnar shape, a circular conical shape, a truncated conical shape, a rectangular-columnar shape, a pyramidal shape, a truncated pyramidal shape, or the like. However, forming the projection into a truncated conical shape as shown in FIGS. 1 and 2 is most preferable from the viewpoint of improvement in the performance in gripping the ground surface. Small depressions may be formed on the tip end surface of the projection. Further, the tip end of the projection may have a rounded shape. No limitation is imposed on the shape of the flange portion, and the flange portion may have a circular-ring shape, a rectangular-ring shape, or the like. However, forming the flange portion into a circular-ring shape as shown in FIGS. 1 and 2 is most preferable from the viewpoint of smooth deformation of the flange portion. Further, the projection and the flange are preferably arranged in a coaxial relationship because such arrangement allows the projection to move downward and perpendicularly to the sole. Therefore, the most preferable shape of the projection and the flange portions are such that the projection has a truncated conical shape, the flange portion has a circular-ring shape, and the projection and the flange portion are coaxial with each other.

Further, as shown in FIGS. 1 and 2, the flange portion 68 preferably has a thickness that gradually decreases from the outer edge to the inner edge, from the viewpoint of smooth deformation of the flange portion. Specifically, it is desired that the thickness a at portion X of the flange portion 68 near the outer layer main portion 70 (portion of the outer layer 64 where the lower surface is flat) be made largest, and the thickness b at the portion Y near the projection 66 be made thinnest.

Next, with reference to FIGS. 1 and 2, preferable dimensions of various portions of the sole used in the athletic shoe of the first aspect of the present invention are described.

Thickness a of the thickest portion of the flange portion 68: 2–6 mm, more preferably 3–5 mm.

Thickness b of the thinnest portion of the flange portion 68: 1–5 mm, more preferably 2–4 mm.

Thickness c of the outer layer main portion 70: 1–5 mm, more preferably 2–4 mm.

Thickness d of the inner layer 62 at portions where neither the projection 66 nor the flange portion 68 is formed: 4–15 mm, more preferably 5–10 mm.

Thickness e of the inner layer 62 at the portion where the projection 66 is formed: 1–12 mm, more preferably 1–9 mm.

Outer diameter f of the flange portion 68: 16–24 mm, more preferably 18–22 mm.

Diameter g of the flange portion 68 at position X: f minus 1–8 mm, more preferably f minus 2–6 mm.

Diameter h of the flange portion 68 at position Y (diameter of the projection 66 at the base end): 6–10 mm, more preferably 7–9 mm.

Height i of the projection 66: 7–15 mm, more preferably 9–13 mm.

Angle of the flange portion 68 with respect to the horizontal surface: 10–60°, more preferably 20–50°.

When the thickness of the flange portion is gradually decreased from the outer edge to the inner edge, both the angle $\alpha$ of the lower surface of the flange portion 68 with respect to the horizontal surface and the angle $\beta$ of the upper surface of the flange portion 68 with respect to the horizontal surface are preferably set to fall within the above-described range.

Figure 3:
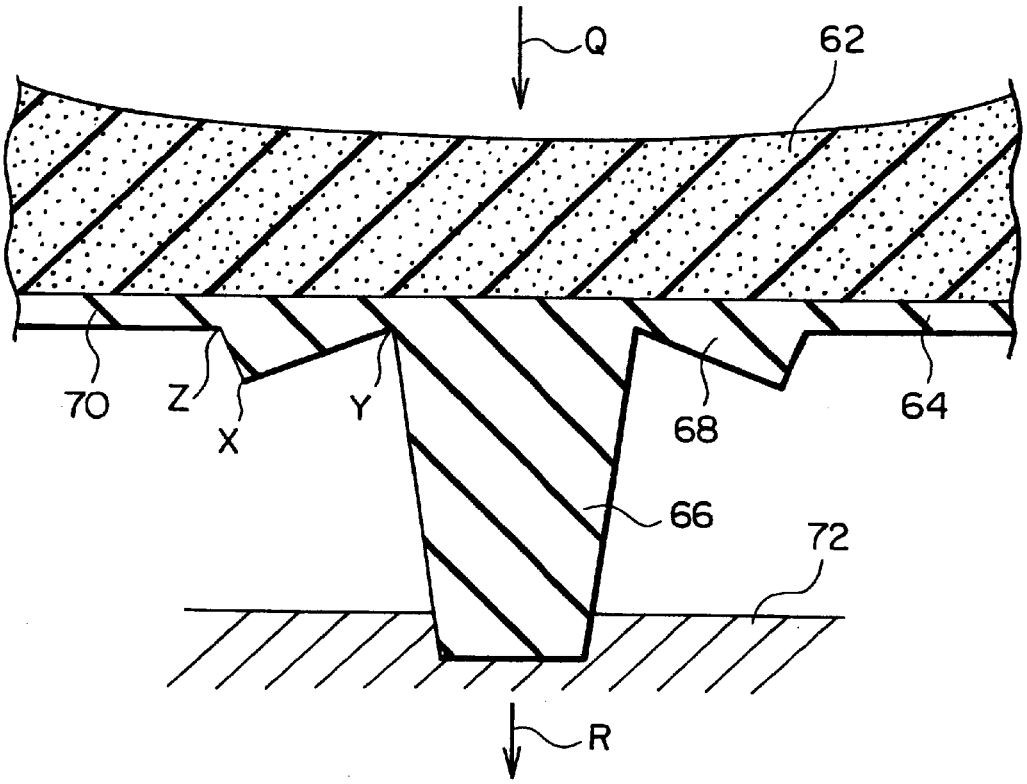
FIG. 3 is a vertical cross-sectional view showing a state in which the flange portion shown in FIG. 2 has deformed and the projection has moved downward.

In the athletic shoe having the sole shown in FIGS. 1 and 2, when a downward pressure greater than a predetermined value acts on the portion where the projection 66 and the flange portion 68 are formed, the flange portion 68 deforms due to the pressure such that the flange portion 68 becomes substantially flat as shown in FIG. 3, or the flange portion slants downward from the outer edge toward the inner edge. As a result, the joint portion Y between the projection 66 and the flange portion 68 moves downward, so that the projection 66 projects downward. That is, since the rigidity of the outer layer 64 changes discontinuously at the joint portion Y between the projection 66 and the flange portion 68, as well as at the joint portion Z between the flange portion 68 and the outer layer main portion 70, concentrated deformations occur at the potions Y and Z, when a pressure greater than the predetermined value acts in the direction of arrow Q in FIG. 3. As a result, the outer layer 64 bends at the portions Y and Z, and therefore the flange portion 68 deforms to move the projection 66 downward. Accordingly, when a large pressure acts on the portion where the projection 66 and the corresponding flange portion 68 are formed while, for example, the player swings a golf club, the projection 66 moves downward as indicated by arrow R in FIG. 3 due to the above-described deformation of the flange portion 68, so that the length of the projection 66 from the sole increases, resulting in an enhanced gripping performance against ground surface 72.

Figure 4:
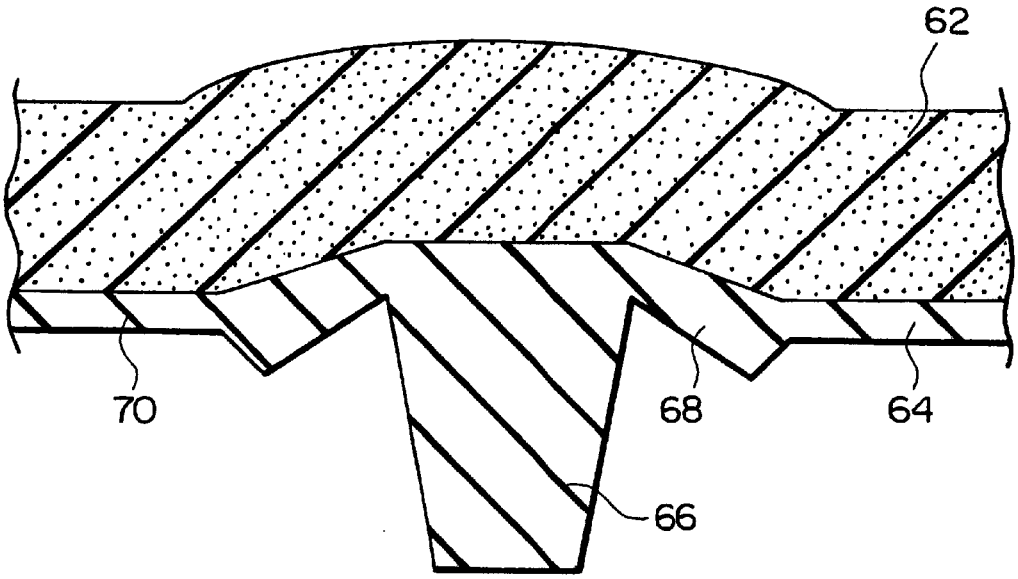
FIG. 4 is a plan view showing another example of a sole on which a projection and a flange portion are provided and which are used in the athletic shoe according to the first aspect of the present invention.

In the example shown in FIGS. 1 and 2, the upper surface of the inner layer 62 is made flat. However, as shown in FIG. 4, the upper surface of the inner layer 62 may be raised at the portion where the projection 66 and the flange portion 68 are formed. This enables smoother downward movement of the projection 66 caused by downward pressure.

In the athletic shoe of the first aspect of the present invention, insofar as the object of the present invention is not impaired, there can be provided on the sole other projections such as ordinary rubber studs, metal studs, soft spikes, etc., as described above, in addition to the projection (hereinafter sometime referred to as the "projection of the first aspect") surrounded by the flange portion. In this case, the other projections are preferably projected downward from the tip end of the projection of the first aspect by about 1–2 mm. However, the present invention is not limited thereto, and the tip ends of the other projections may be flush with the tip end of the projection of the first aspect, or the tip end of the projection of the first aspect may be projected from the tip ends of the other projections.

Figure 5:
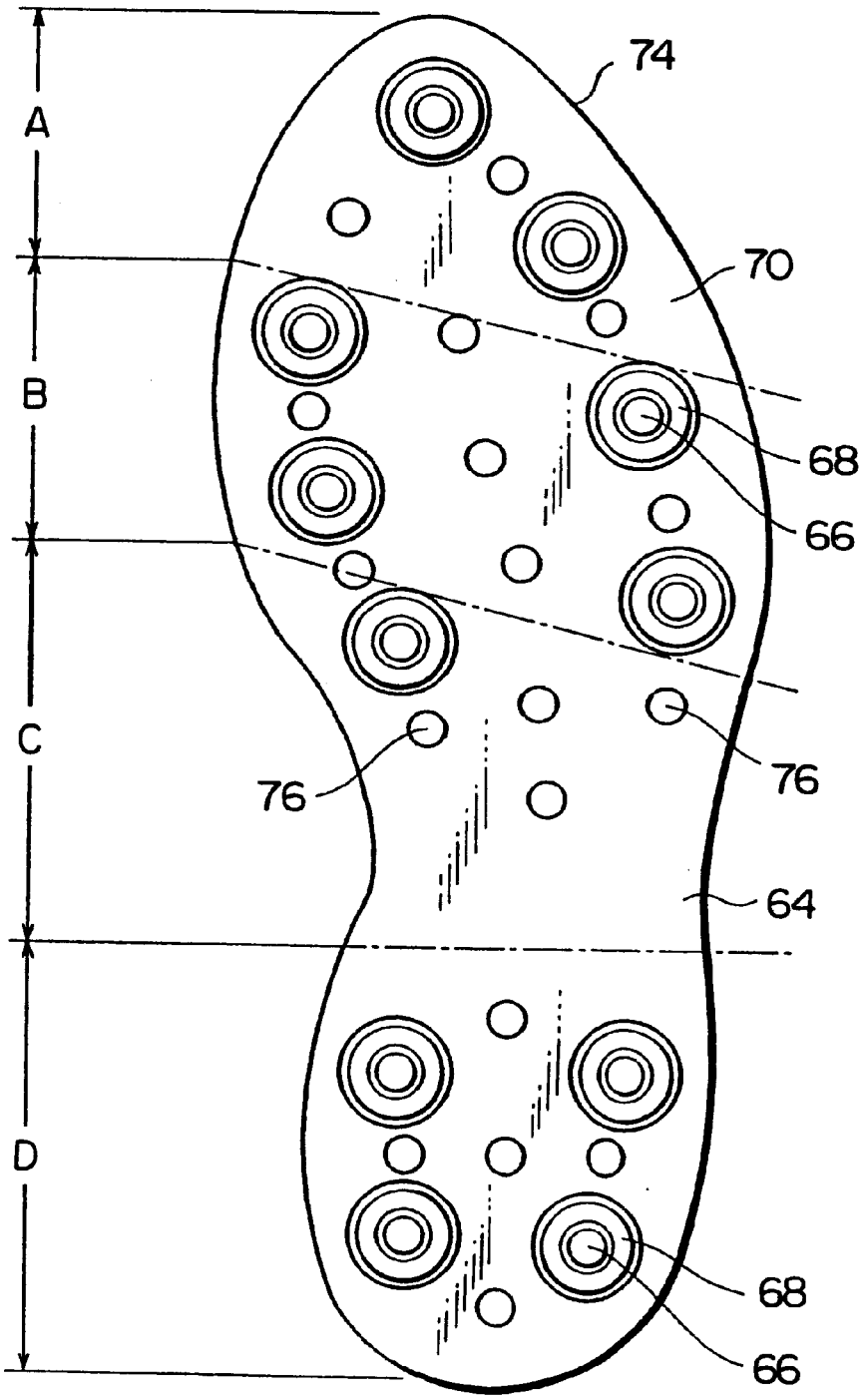
FIG. 5 is a plan view of the sole of a golf shoe according to an embodiment of the first aspect of the present invention.

FIG. 5 is a plan view of the sole of an athletic shoe (a golf shoe) according to an embodiment of the first aspect of the present invention. The sole 74 of the present embodiment is composed of an inner layer and an outer layer 64. The inner layer is formed of EVA (Asker hardness: 60°), while the outer layer 64 is formed of a synthetic rubber (JIS-A hardness: 72°). Asker hardness is measured by using a spring type hardness tester type Asker C in accordance with SRIS 0101 (Standard by the Society of Rubber Industry, Japan).

When the sole 74 of the present embodiment is divided into a toe portion A, a tread portion B, an arch portion C, and a heel portion D, two projections 66 of the first aspect are disposed in the toe portion A; four projections 66 of the first aspect are disposed in the tread portion B, one projection 66 of the first aspect is disposed in the arch portion C, and four projections 66 of the first aspect are disposed in the heel portion D. In the sole 74 of the present embodiment, in addition to the projections 66 of the first aspect, ordinary rubber studs 76 are disposed in a proper manner between the projections 66 of the first aspect as well as in the center area of the sole 74.

The various portions of the sole 74 of the present embodiment have the following dimensions (see FIGS. 1 and 2):

Thickness a of the thickest portion of the flange portion 68: 4.1 mm.

Thickness b of the thinnest portion of the flange portion 68: 3 mm.

Thickness c of the outer layer main portion 70: 3 mm.

Thickness d of the inner layer 62 at portions where neither the projection 66 nor the flange portion 68 is formed: 6 mm.

Thickness e of the inner layer 62 at the portion where the projection 66 is formed (thinnest portion): 3 mm.

Outer diameter f of the flange portion 68: 20 mm.

Diameter g of the flange portion 68 at position X: 18 mm.

Diameter h of the flange portion 68 at position Y (diameter of the projection 66 at the base end): 8 mm.

Height i of the projection 66: 11 mm.

Angle $\alpha$ of the lower surface of the flange portion 68 with respect to the horizontal surface: 39°.

Angle $\beta$ of the upper surface of the flange portion 68 with respect to the horizontal surface: 27°.

Second Aspect of the Invention

The sole used in the athletic shoe according to the second aspect of the present invention may have a single-layer structure or a double-layer structure composed of an inner layer and an outer layer that comes into contact with the ground surface. When the sole has a single-layer structure, examples of materials suitable for the sole include foamed elastic products such as foamed rubber and foamed plastic; unfoamed rubber and plastic; and the like.

When the sole has a double-layer structure, the inner layer is preferably made softer than the outer layer, because the effect of the projection and the depression can be obtained more effectively. Examples of materials suitable for the inner layer include foamed elastic products such as foamed rubber and foamed plastic; unfoamed rubber; and the like. More specifically, foamed EVA (ethylene vinylacetate), ordinary foamed rubber, foamed polyurethane, and the like are preferably used. The material of the inner layer preferably has a hardness of 50–90°, more preferably, 60–80° (Asker-C hardness). Examples of materials suitable for the outer layer include rubber and rubber-like elastic materials. More specifically, unfoamed rubber, thermoplastic urethane, Nylon, and the like are preferably used. The material of the inner layer preferably has a hardness of 55–95°, more preferably 65–85° (JIS-A hardness). Each of the inner and outer layers may have a single-layer structure of a single material, or a multi-layer structure composed of a plurality of layers formed of different materials.

No limitation is imposed of the kind of the projections. For example, the projections may be rubber studs integrally formed with the sole such that parts of the sole are projected to form the studs, metal pins of metal studs removably attached to the sole, or mushroom-cap-shaped projections of soft spikes removably attached to the sole. Further, no limitation is imposed on the shape of the projections. For example, the projection may be of a cylindrical-columnar shape, a circular conical shape, a truncated conical shape, a rectangular-columnar shape, a pyramidal shape, a truncated pyramidal shape, a mushroom-cap-like shape, a circular-disc-like shape, or the like. Small depressions may be formed on the tip end surface of the projection. Further, the tip end of the projection may have a rounded shape.

The shape and manner of arrangement of the depressions may be determined freely. However, in order to obtain the function of the projection and the depression more effectively, it is preferred that the depression is formed into a circular-ring shape centered at the center axis of the projection so as to surround the projection, or that a plurality of depressions are formed along a concentric circle centered at the center axis of the projection so as to surround the projection. Insofar as the object of the present invention is not impaired, other projections may be provided on the sole of the athletic shoe according to the second aspect of the invention in addition to the projection of the second aspect, in the vicinity of which depression is formed.

Further, in order to obtain the effect of the projection and the depression more effectively, the distance between the projection and the depression is preferably set to 0–15 mm, more preferably, 0–10 mm; the width of the depression is preferably set to 1–10 mm, more preferably, 3–7 mm; and the depth of the depression is preferably set to 0.5–5 mm, more preferably, 1–3 mm.

First Embodiment

Figure 6:
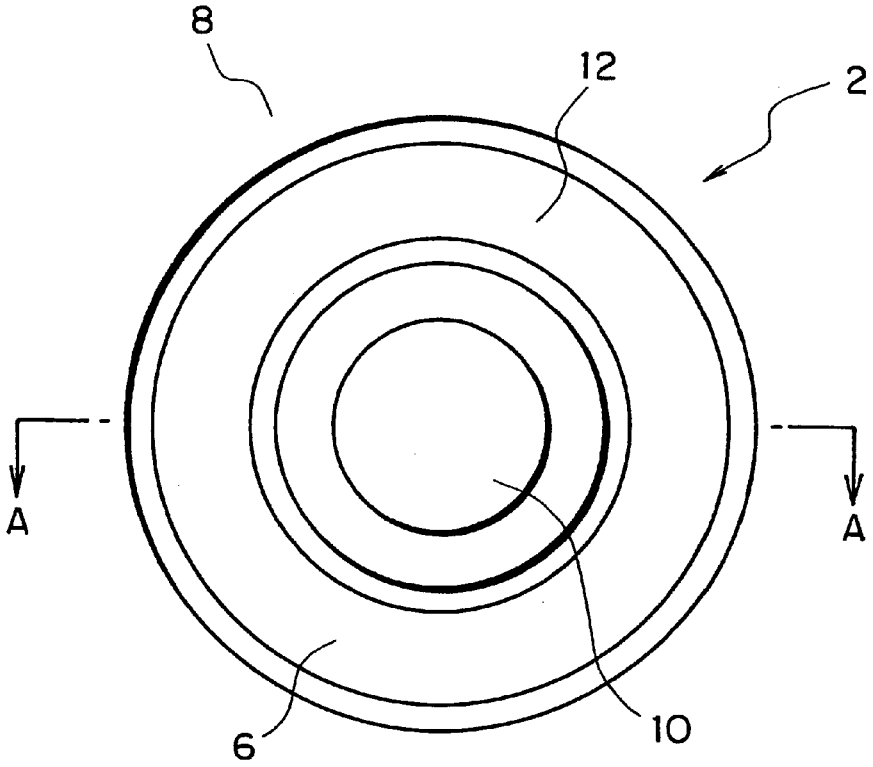
FIG. 6 is a plan view showing the slip prevention means of the sole of an athletic shoe (a golf shoe) according to a first embodiment of the second aspect of the present invention.
Figure 7:
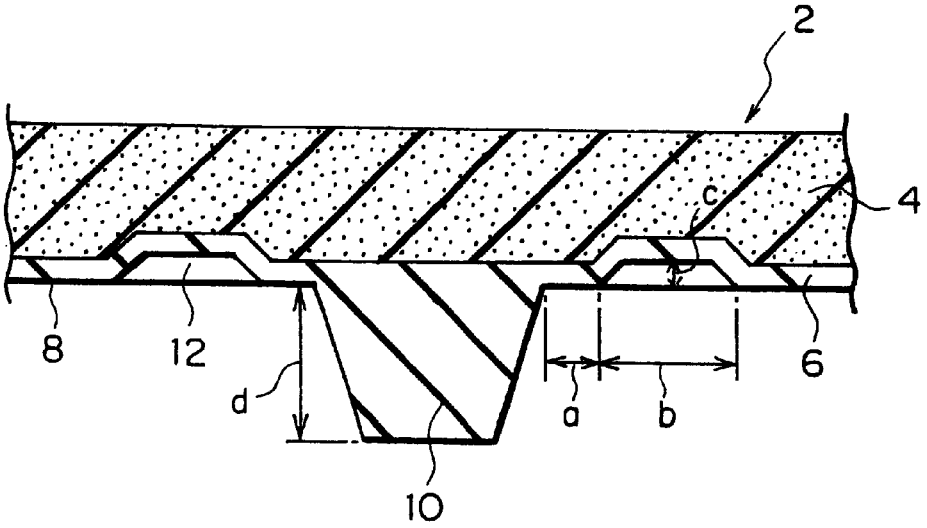
FIG. 7 is a cross-sectional view along line A—A in FIG. 6.

FIG. 6 is a plan view showing the slip prevention means of the sole of an athletic shoe (a golf shoe) according to a first embodiment of the second aspect of the present invention; and FIG. 7 is a cross-sectional view along line A—A in FIG. 6. The sole 2 of the present embodiment has a double-layer structure composed of an inner layer 4 and an outer layer 6, each of which has a single layer structure. The inner layer 4 is formed of foamed rubber (Asker-C hardness: 65°), and the outer layer 6 is formed of unfoamed rubber (JIS-A hardness: 75°), and therefore, the inner layer 4 is softer than the outer layer 6.

On the outer surface 8 of the sole 2 of the present embodiment are provided rubber studs serving as projections 10, which are integrally formed with the sole 2 to be projected from the outer layer 6. Further, a depression 12 is formed to surround the projection 10. The depression 12 has a circular-ring shape that is centered at the center axis of the projection 10. In the present embodiment, the depression 12 is formed by depression of both the inner layer 4 and the outer layer 6.

In the sole 2 of the present embodiment, the distance a between the projection 10 and the depression 12 is 1 mm; the width b of the depression 12 is 5 mm; and the depth c of the depression 12 is 2 mm. When the projection 10 is formed of a rubber stud as in the present embodiment, the height d of the projection 10 is preferably set to 3–6 mm.

Second Embodiment

Figure 8:
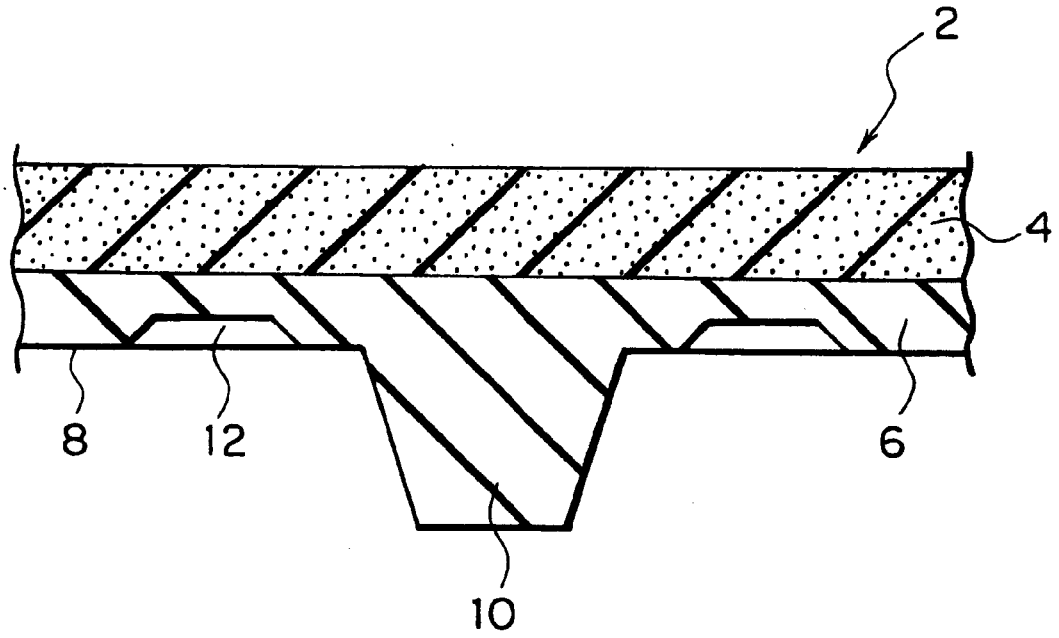
FIG. 8 is a cross-sectional view showing the slip prevention means of the sole of an athletic shoe (a golf shoe) according to a second embodiment of the second aspect of the present invention.

FIG. 8 is a cross-sectional view showing the slip prevention means of the sole of an athletic shoe (a golf shoe) according to a second embodiment of the second aspect of the present invention. The sole 2 of the present embodiment is identical to the sole 2 of the first embodiment except that the thickness of the outer layer 6 is increased compared to that of the sole 2 of the first embodiment while the thickness of the inner layer 4 is decreased accordingly, and that the depression 12 is formed by depression of only the outer layer 6. Therefore, in FIG. 8, portions having the same structure as in FIG. 7 are denoted by the same reference symbols, and their descriptions will be omitted.

Third Embodiment

Figure 9:
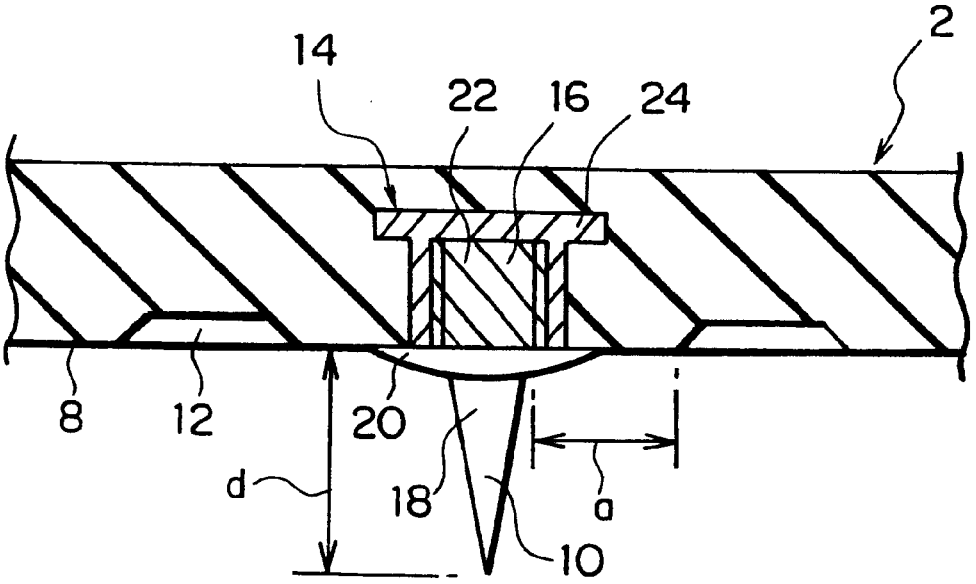
FIG. 9 is a cross-sectional view showing the slip prevention means of the sole of an athletic shoe (a golf shoe) according to a third embodiment of the second aspect of the present invention.

FIG. 9 is a plan view showing the slip prevention means of the sole of an athletic shoe (a golf shoe) according to a third embodiment of the second aspect of the present invention. The sole 2 of the present embodiment has a single-layer structure and is formed of butadiene rubber (JIS-A hardness: 90°).

A metal stud 14 is removably attached to the sole 2 of the present embodiment. The metal stud 14 is composed of a spike body 22 and a pedestal 24 embedded in the sole 2. The spike body 22 has a base portion 16 having a thread on its outer periphery, a conical metal pin 18 projecting from the lower end of the base portion 16, and a cap portion 20 formed between the base portion 16 and the pin 18. The base portion 16 of the spike body 22 is screwed into the pedestal 24. Therefore, in the sole 2 of the present embodiment, the metal pin 18 of the metal stud 14 forms the projection 10. Further, on the outer surface 8 of the sole 2 of the present embodiment, a depression 12 is formed to surround the projection 10 and to be located in the vicinity thereof. The depression 12 has a circular-ring shape centered at the center axis of the projection 10.

In the sole 2 of the present embodiment, the distance a between the projection 10 and the depression 12 is 10 mm; and the width and depth of the depression 12 are the same as those of the first embodiment. When the projection 10 is formed of a metal pin of the metal stud as in the present embodiment, the height d of the projection 10 is preferably set to be smaller that the conventional height by an amount corresponding to the depth of the depression. More specifically, the height d of the projection 10 is preferably set to 4–7 mm.

Fourth Embodiment

Figure 10:
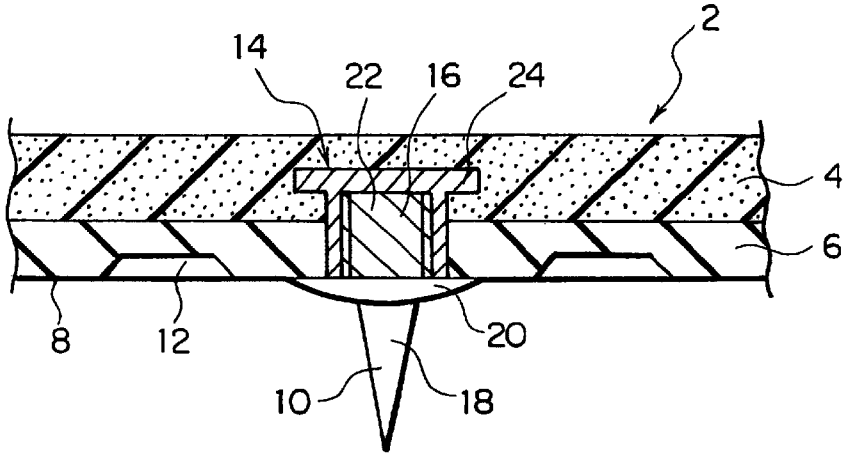
FIG. 10 is a cross-sectional view showing the slip prevention means of the sole of an athletic shoe (a golf shoe) according to a fourth embodiment of 2o the second aspect of the present invention.

FIG. 10 is a cross-sectional view showing the slip prevention means of the sole of an athletic shoe (a golf shoe) according to a fourth embodiment of the second aspect of the present invention. The sole 2 of the present embodiment is identical to the sole 2 of the third embodiment except that the sole has a double layer structure as in the second embodiment. Therefore, in FIG. 10, portions having the same structures as those shown in FIGS. 8 and 9 are denoted by the same reference symbols, and their descriptions will be omitted.

Fifth Embodiment

Figure 11:
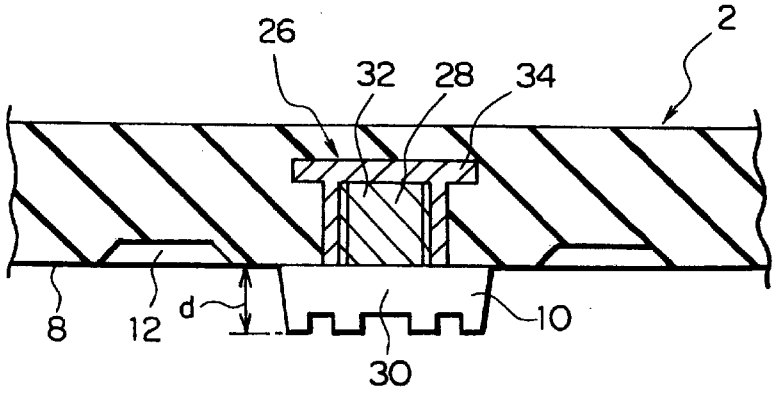
FIG. 11 is a cross-sectional view showing the slip prevention means of the sole of an athletic shoe (a golf shoe) according to a fifth embodiment of the second aspect of the present invention.

FIG. 11 is a cross-sectional view showing the slip prevention means of the sole of an athletic shoe (a golf shoe) according to a fifth embodiment of the second aspect of the present invention. The sole 2 of the present embodiment has a single-layer structure and is formed of the same material as that used in the third embodiment.

A soft spike 26 is removably attached to the sole 2 of the present embodiment. The soft spike 26 is composed of a spike body 32 and a pedestal 34 embedded in the sole 2. The spike body 32 has a base portion 28 having a thread on its outer periphery, and a mushroom-cap-shaped projection 30 formed of polyurethane and projecting from the lower end of the base portion 28. The base portion 28 of the spike body 32 is screwed into the pedestal 34. Small depressions are formed on the tip end surface of the projection 30. Therefore, in the sole 2 of the present embodiment, the mushroom-cap-shaped projection 30 of the soft spike 26 forms the projection 10. Further, on the outer surface 8 of the sole 2 of the present embodiment, a depression 12 is formed to surround the projection 10 and to be located in the vicinity thereof. The depression 12 has a circular-ring shape that is centered at the center axis of the projection 10.

In the sole 2 of the present embodiment, the distance between the projection 10 and the depression 12 and the width and depth of the depression 12 are the same as those of the first embodiment. When the projection 10 is formed of a mushroom-cape-shaped projection of the soft spike, the height d of the projection 10 is preferably set to 4–7 mm.

Sixth Embodiment

Figure 12:
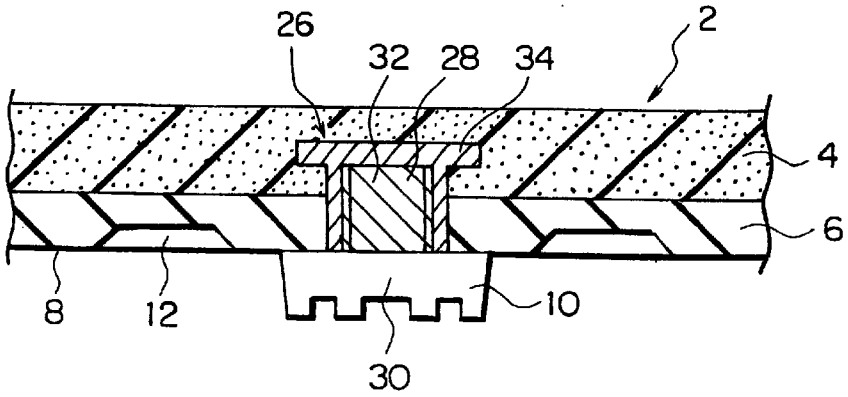
FIG. 12 is a cross-sectional view showing the slip prevention means of the sole of an athletic shoe (a golf shoe) according to a sixth embodiment of the second aspect of the present invention.

FIG. 12 is a cross-sectional view showing the slip prevention means of the sole of an athletic shoe (a golf shoe) according to a sixth embodiment of the second aspect of the present invention. The sole 2 of the present embodiment is identical to the sole 2 of the fifth embodiment except that the sole has a double layer structure as in the second embodiment. Therefore, in FIG. 12, portions having the same structures as those shown in FIGS. 8 and 11 are denoted by the same reference symbols, and their descriptions will be omitted.

Seventh Embodiment

Figure 13:
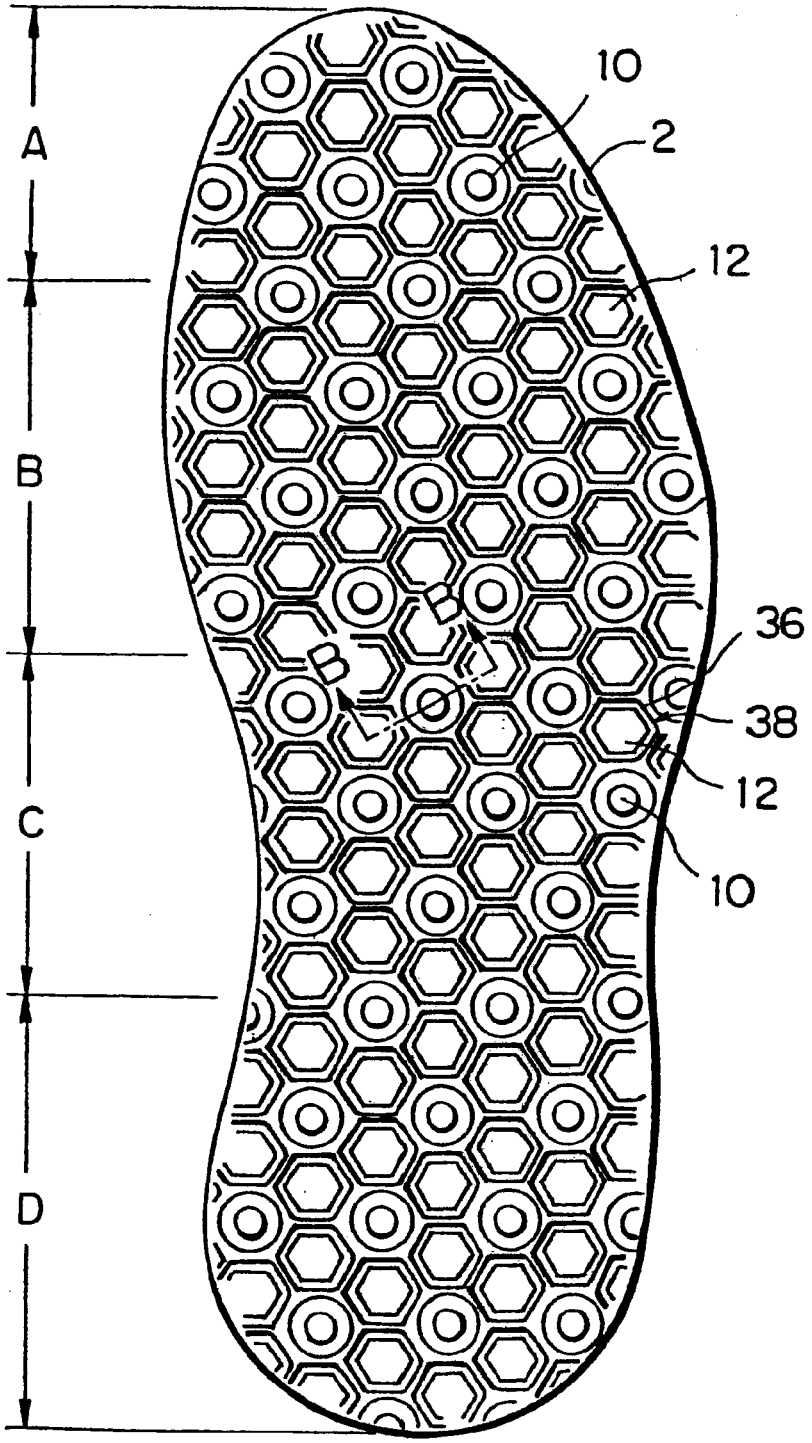
FIG. 13 is a plan view of an athletic shoe (a golf shoe) according to a seventh embodiment of the second aspect of the present invention.
Figure 14:
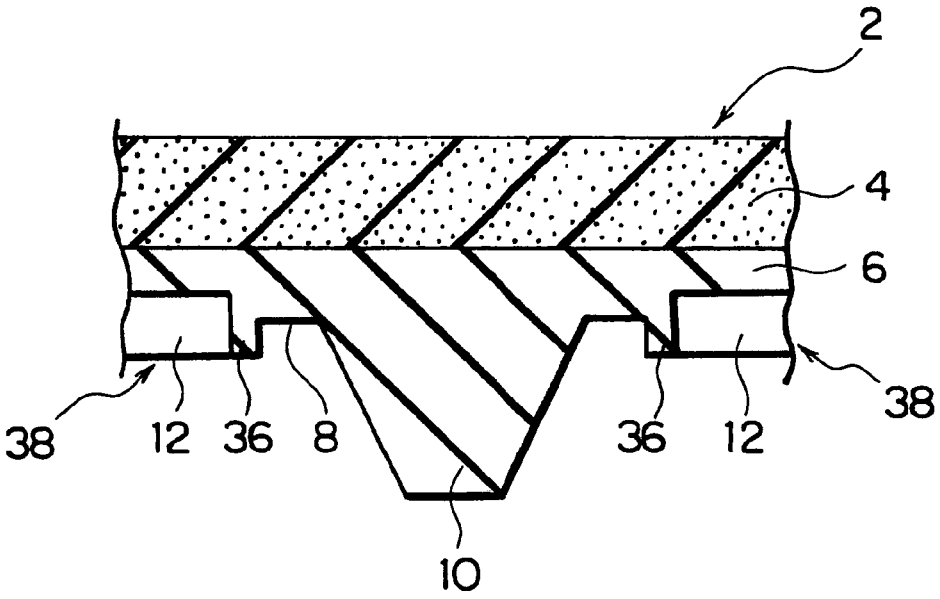
FIG. 14 is a cross-sectional view along line B—B in FIG. 13.

FIG. 13 is a plan view of an athletic shoe (a golf shoe) according to a seventh embodiment of the second aspect of the present invention; and FIG. 14 is a cross-sectional view along line B—B in FIG. 13. The sole 2 of the present embodiment has a double-layer structure as in the second embodiment.

On the outer surface 8 of the sole 2 of the present embodiment are formed many rubber studs serving as projections 10, which are similar to those used in the second embodiment. Further, around each projection 10, six segments 38 are disposed in the vicinity of the projection 10. Each segment 38 is composed of a hexagonal peripheral wall 36 and a hexagonal depression 12 formed within the hexagonal peripheral wall 36. Thus, the depressions 12 are formed along a concentric circle centered at the center axis of the projection 10 so as to surround the projection 10. In the present embodiment, since the projections 10 are disposed uniformly and densely throughout the entire surface of the sole 2, a plurality of projections 10 share a single depression 12 (segment 38). The shape of the peripheral wall is not limited to hexagonal, and may be any shape such as circular, rectangular, or the like.

When segments each having a peripheral wall and a depression 12 formed therein are disposed in the vicinity of the projection 10, the height of the bottom surface of the depression 12 is set to the same height as in the first through sixth embodiments, and the lower end of the peripheral wall can be projected downward to, for example, a point substantially corresponding to half the height of the projection 10. However, the lower end of the peripheral wall can be projected only up to the point corresponding to the tip end of the projection 10.

No limitation is imposed on the manner of arrangement of the projections 10 on the sole 2. For example, in addition to the uniform arrangement as shown in FIG. 13, there can be employed an arrangement such that the projections 10 are disposed densely at the tread portion B and the heel portion D to which a large portion of the body weight of a user acts during walking or play, and relatively sparsely at the toe portion A, while no projections 10 are disposed at the arch portion C.

Eighth Embodiment

Figure 15:
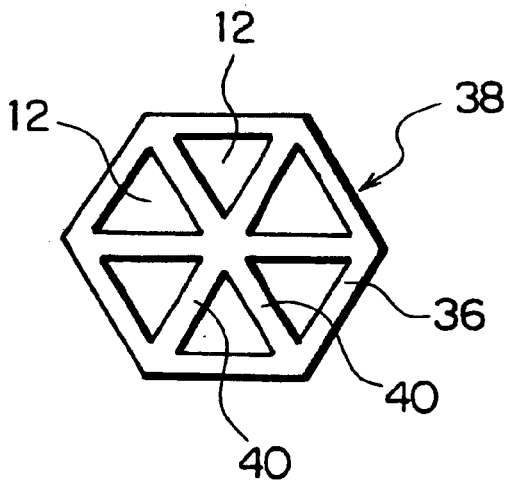
FIG. 15 shows a plan view showing an example of a segment in which depressions are formed inside a peripheral wall.

FIG. 15 shows a plan view showing another example of a segment in which depressions are formed inside a peripheral wall. In the segment 38 of the present embodiment, the area within the hexagonal peripheral wall 36 is partitioned by means of partition walls 40 in order to form six triangular depressions 12 within the peripheral wall 36. When segments each having a peripheral wall, partition walls, and depressions 12 formed therein are disposed in the vicinity of the projection 10, the height of the bottom surface of the depression 12 is set to the same height as in the first through sixth embodiments, and the lower end of the peripheral wall can be projected downward to, for example, a point substantially corresponding to half the height of the projection 10. However, the lower end of the peripheral wall can be projected only up to the point corresponding to the tip end of the projection 10.

What is claimed is:

1. An athletic shoe comprising a sole composed of an inner layer and an outer layer that comes into contact with the ground surface, wherein a plurality of downward projecting projections are formed on the lower surface of said outer layer as parts of said outer layer, and a ring-shaped flange portion is formed as a part of said outer layer to surround said corresponding projection, said ring-shaped flange portion slanting upward from its outer edge toward the inner edge, whereby when a downward pressure greater than a predetermined value acts onto a portion where said projection and said corresponding flange portion are formed, said flange portion deforms in order to move said projection downward.

2. An athletic shoe according to claim 1, wherein said inner layer is formed of a material having flexibility, while said outer layer is formed of a rubber or elastic material.

3. An athletic shoe according to claim 1, wherein the material of said inner layer has an Asker harness of 40–80°, and the material of said outer layer has a JIS-A harness of 50–90°.

4. An athletic shoe according to claim 1, wherein the thickness of said flange portion is gradually reduced from the outer edge toward the inner edge of said flange portion.

5. An athletic shoe according to claim 1, wherein said projection has a truncated conical shape, while said flange portion has a circular-ring shape; and said projection and said flange portion are arranged concentrically.

* * * * *